US006044505A

United States Patent [19]

Friedman

[11] Patent Number: 6,044,505

[45] Date of Patent: Apr. 4, 2000

[54] SUPPORT PILLOW FOR PREGNANT WOMEN, OBESE PEOPLE, PEOPLE WHO SUFFER FROM VARIOUS FORMS OF BACK PAIN AND PEOPLE WHO SUFFER FROM SLEEP APNEA, SNORING AND SCIATICA

[76] Inventor: Loretta Friedman, 9269 Shore Rd., Apt. B1, Brooklyn, N.Y. 11209

[21] Appl. No.: 09/141,222

[22] Filed: Aug. 27, 1998

Related U.S. Application Data

[63] Continuation-in-part of application No. 29/062,009, Nov. 5, 1996, Pat. No. Des. 397,576.

[51] Int. Cl.[7] ..... A47C 20/00

[52] U.S. Cl. ..... 5/631; 5/930; D6/601

[58] Field of Search ..... 5/631, 632, 930, 5/636, 655, 732; D6/596, 601

[56] References Cited

U.S. PATENT DOCUMENTS

| | | | |
|---|---|---|---|
| D. 22,191 | 1/1893 | Varnum | D6/601 |
| D. 279,642 | 7/1985 | Ross | D6/596 |
| D. 289,481 | 4/1987 | Reddick | D6/601 |
| 4,288,879 | 9/1981 | Pate | 5/631 |
| 5,153,960 | 10/1992 | Ritter et al. | 5/640 |
| 5,165,130 | 11/1992 | Wendling | 5/655 |
| 5,551,108 | 9/1996 | Butler, III | 5/655 |
| 5,813,066 | 10/1998 | Gebhard et al. | 5/655 |
| 5,822,817 | 10/1998 | Carew et al. | 5/732 |

FOREIGN PATENT DOCUMENTS

| | | | |
|---|---|---|---|
| 3327677 | 2/1985 | Germany | 5/630 |

*Primary Examiner*—Terry Lee Melius
*Assistant Examiner*—James M Hewitt
*Attorney, Agent, or Firm*—Michael R. Gilman; Kaplan & Gilman LLP

[57] ABSTRACT

A pillow (10) for pregnant, over weight, back-pain suffering, sleep apnea suffering, and sciatica suffering persons lying in a prone position, is provided. The pillow has an aperture (90) extending through it, and is sized for receipt of a portion of the abdomen of the user. The aperture is defined by at least first (20), second (30) and third (40) support structures, and is of a substantially uniform thickness (T). The first support structure extends substantially traversely across the lower-chest and upper-abdominal regions of the user, the second support structure extends along a first side-abdominal region of the user to end proximate to the person's pelvic region, and the third support structure extends along a second side-abdominal region of the user to also end proximate to the pelvic region of the user.

6 Claims, 14 Drawing Sheets

50
130
70
T
60
10

50
70
44
34
60
30
10

95
97
10

SUPPORT PILLOW FOR PREGNANT WOMEN, OBESE PEOPLE, PEOPLE WHO SUFFER FROM VARIOUS FORMS OF BACK PAIN AND PEOPLE WHO SUFFER FROM SLEEP APNEA, SNORING AND SCIATICA

This application is a continuation-in-part of application Ser. No. 29/062,009, filed Nov. 5, 1996, now U.S. Design Pat. No. 397,576.

BACKGROUND OF THE INVENTION

This invention relates to the field of pillows, and more particularly, to the field of abdominal support pillows for pregnant women, over weight people and otherwise regular people who suffer from back pain.

Citizens of the United States spend eleven percent of the nation's gross national product on hospital and medical care. The United States has more doctors and hospitals that nearly any other industrialized nation, and yet the United Nations World Health Organization continually rates the population of the United States as having one of the lowest general health indexes in the world.

The symptoms of bad health and poor physical condition are the end result of the body's inability to function properly. Currently, if you are a pregnant woman, an obese person, an athlete, an individual who suffers from back pain, sleep apnea, snoring or sciatica, your ability to lay on your stomach is greatly diminished. The posture that is assumed during pregnancy, or in the obese, creates hyper-extension in the low back region, causing jamming of the thoracolumbar facets, posterior narrowing of the disc space and myospasms in the erector spinae muscles. Sciatica, and lower back pain, are usually caused by misalignment of bones, nerve interference and vertebral subluxation.

Currently, society's (doctor's) emphasis has been on the removal of symptoms, rather than on creating an environment in which the body can function as close to 100% as possible, without intrusive and costly medical procedures. In addition, while pillows, and in particular, pillows that provide additional support or cushioning to those areas of a person's body where he/she is experiencing pain, are old in the art, most do not serve the function of helping to fix the problem, or relieve the pain, but only address the short term; i.e., comfort during sitting or laying down. In particular, today, support and comfort pillows are used in a variety of different ways; under one's head while he/she sleeps, behind one's back as he/she sits on a chair (for lumbar support), along one's body while he/she sleeps on his/her side, under one's buttocks while sitting, and even under one's knees while laying on one's back.

Today's pillows are also made from a wide variety of different materials; from fowl feathers, synthetic fibers and foam, for the internal stuffing of a pillow, to natural cottons and wools, synthetic fibers and a combination of natural and synthetic fibers, for the outside covering (if there is to be one). Pillows also come in many varied and different shapes and sizes, depending upon the purpose of the pillow, the comfort level sought, and/or often simply for style.

The prior art even discusses the existence of pillows which appear to serve one of the intended purpose of the subject invention; abdominal support for pregnant women wishing, or needing, to lie prone, on their stomachs for comfort, or while at a doctor's/chiropractor's office. In this regard, one is directed to the inventions disclosed in the U.S. patents to Singer-Leyton et al. and Wall, U.S. Pat. Nos. 5,504,953 and 4,944,059, entitled, respectively, Cushion Support for a Person During Massage, and Prenatal Body Support.

The Singer-Leyton et al. pillow is of less relevance to the subject invention, since its desired effect is to provide a general recess 12 of which the purpose is simply to provide a space for a pregnant user's hyper-extended abdomen, while the person is lying prone for a massage. Since the Singer-Leyton pillow is for the simple purpose of comfort for a pregnant woman during massage, and not, as is the purpose of the subject invention, for back rehabilitation (whether that rehabilitation is due to the person simply lying in a proper, relief position, or due to a doctor/chiropractor working on the prone person), the Singer-Leyton pillow has different construction attributes. In particular, Singer-Leyton has a complicated raised head and neck support structure and lower body/leg support structure, resulting in the prone person's body being disposed so that her head, neck, back, buttock and leg regions are all in a substantially horizontal plane; all for the purpose of giving a proper massage.

Of more particular relevance to the subject invention, is the patent to Wall. In Wall, lower back pressure, weight relieving prenatal support, and, even, back rehabilitation, are provided. While the subject invention achieves results, and is partially for a purpose similar to that of Wall, these purposes are achieved through a different construction than that used and claimed in Wall.

To achieve its purposes, Wall discloses a head support portion H, constructed integrally with support A. Wall also discloses receipt of the woman's breasts into recess R, along with her abdomen, and a non-uniform height for the support, generally sloping downward from support portion P, along portions L to head support portion H. In contrast, the subject invention invents away from the teaching of Wall.

The subject invention simplifies the construction of the Wall invention by eliminating the need for a head support, a recess capable of receiving the woman's breasts, and a sloping support structure. In addition, the subject invention, by eliminating a breast receiving recess and a head support, is much smaller in overall size than the Wall invention, enabling the subject pillow to be routinely portable by the user to any and all locations. Such portability ensures the user's access to the relief the pillow gives no matter where the user goes. In particular, throughout any day, and in any location, the user of the subject invention can gently and securely realign his/her lower back, create slight pelvic traction, and create more room between his/her chest and the platform he/she is lying on for easier breathing and less rotation of his/her cervical spine.

Accordingly, it would be desirable to provide a pillow that supports pregnant women, obese, back-pain suffering, sleep apnea suffering and sciatica suffering people, while they are lying in a prone position, which pillow simplifies past constructions of such pillows in such a way as to make them more accessible for regular use in any and all locations.

SUMMARY OF THE INVENTION

In accordance with the invention, a support pillow for a pregnant, over weight, back-pain suffering, sleep apnea suffering, and sciatica suffering person lying in a prone position, is provided. The pillow has an aperture extending through it, and sized for receipt of a portion of the abdomen of the person. The aperture is defined by at least first, second and third support structures, and is of a substantially uniform thickness. The first support structure extending substantially traversely across the lower-chest and upper-abdominal regions of the person, the second support structure extending along a first side-abdominal region of the person to end proximate to the person's pelvic region, and the third support structure extending along a second side-abdominal region of the person to also end proximate to the pelvic region of the person.

Accordingly, it is an object of the invention to provide an improved pillow which supports a pregnant, over weight, back-pain suffering, sleep apnea suffering and sciatica suffering person.

Still another object of the invention is to provide an improved pillow to support pregnant, over weight, back-pain suffering, sleep apnea suffering and sciatica suffering people, which is constructed in such a way as to be more compact and, at the same time, more supportive than the existing art.

Yet another object of the invention is to provide an improved pillow to support pregnant, over weight, back-pain suffering, sleep apnea suffering and sciatica suffering people, wherein the pillow is substantially uniform in thickness from its front to its back.

Still a further object of the invention is to provide an improved pillow to support pregnant, over weight, back-pain suffering, sleep apnea suffering and sciatica suffering people, having an aperture for receipt therein of the person's abdomen, not inclusive of the person's breasts.

Yet a further object of the invention is to provide an improved pillow to support pregnant, over weight, back-pain suffering, sleep apnea suffering and sciatica suffering people, for creating carefully controlled and directed pressure to the pelvis and abdominal region to tilt the pelvis while in a prone position so as to remove interference from spinal structures jamming together, to allow for relief of muscle spasms, to reduce nerve irritation and to, in general, relieve back pain.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

A

DETAILED DESCRIPTION OF THE PREFERRED EMBODIMENTS

Figure 1:
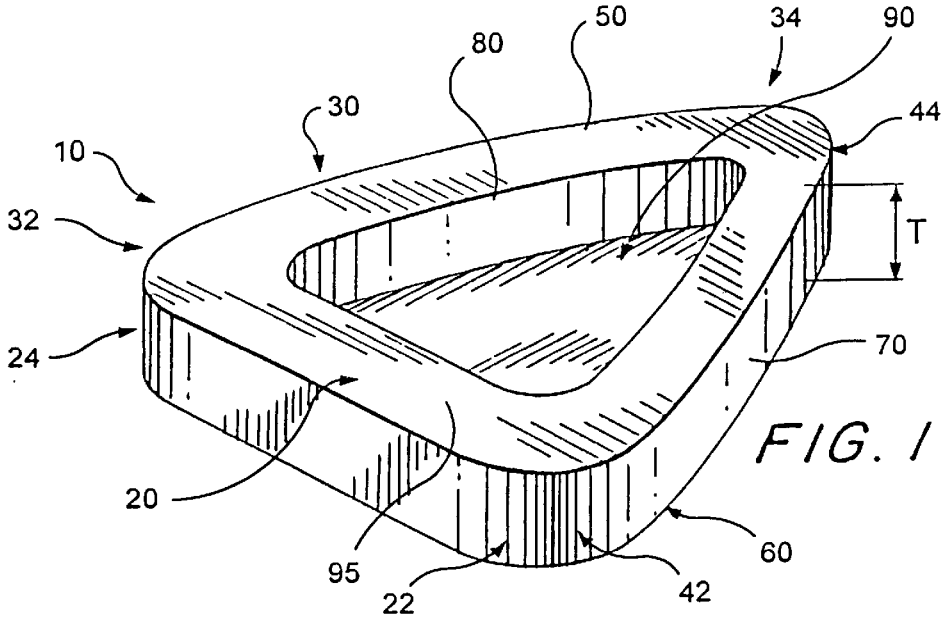
FIG. 1 is a perspective view of a first embodiment of the subject invention.
Figure 2:
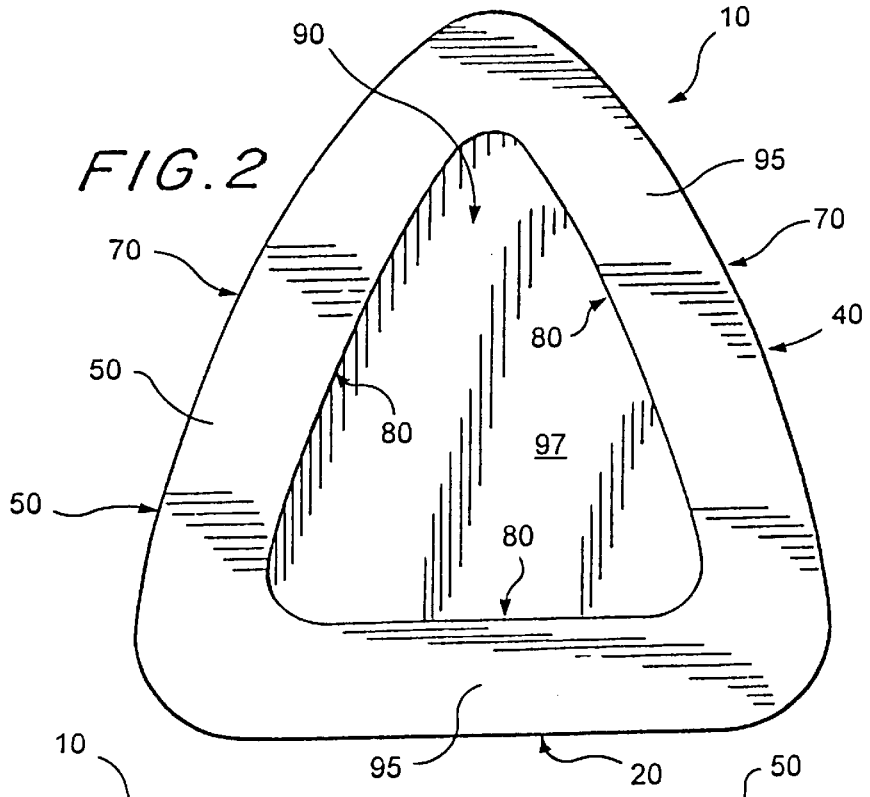
FIG. 2 is a top plan view of a first embodiment of the subject invention.
Figure 3:
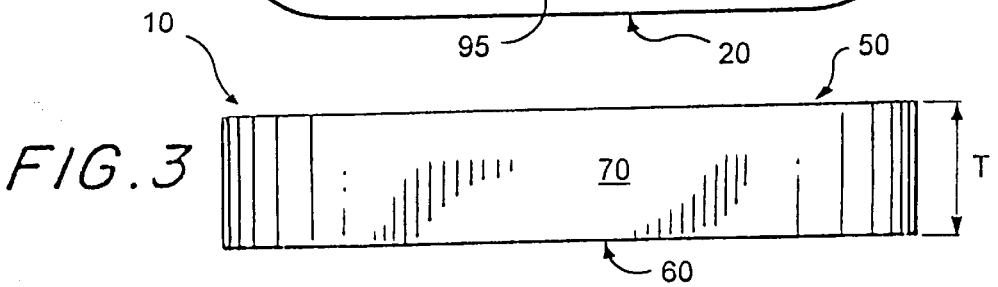
FIG. 3 is a front elevational view of a first embodiment of the subject invention.
Figure 4:
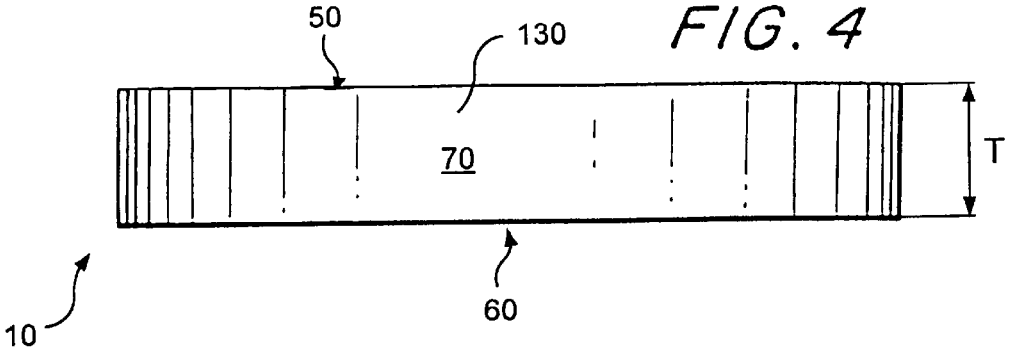
FIG. 4 is a left-side elevational view of a first embodiment of the subject invention, the right-side elevational view being a mirror image thereof.
Figure 5:
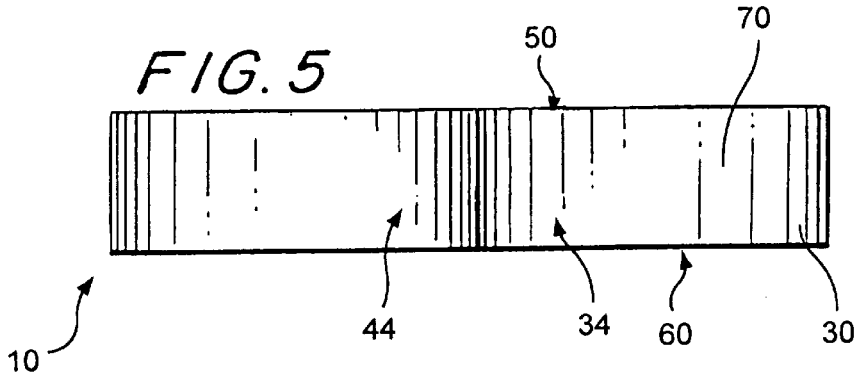
FIG. 5 is a rear elevational view of a first embodiment of the subject invention.
Figure 6:
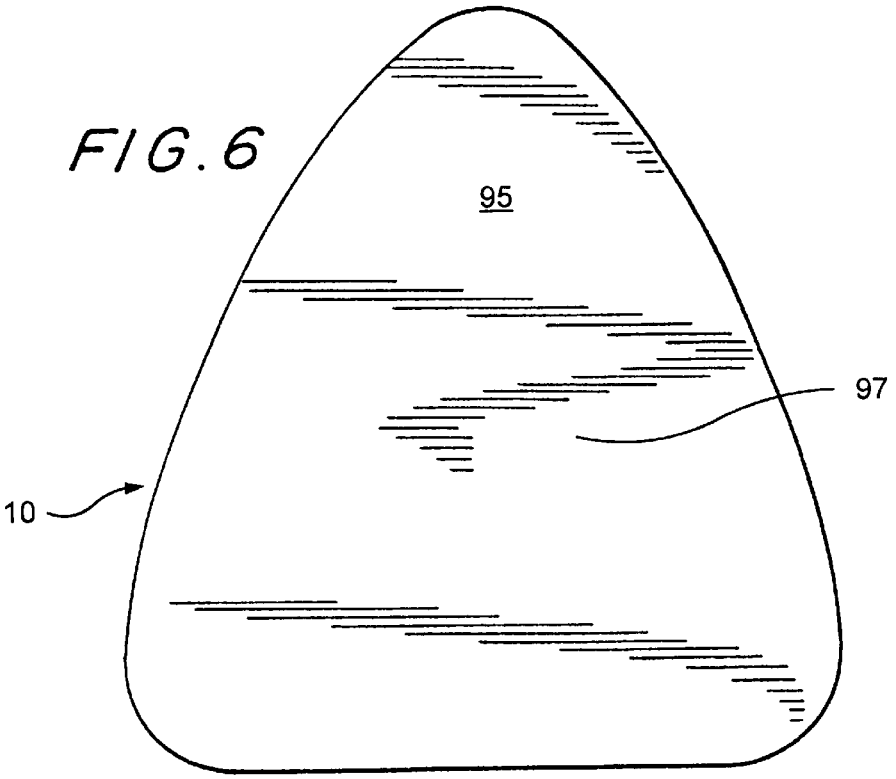
FIG. 6 is a bottom plan view of a second embodiment of the subject invention.
Figure 7:
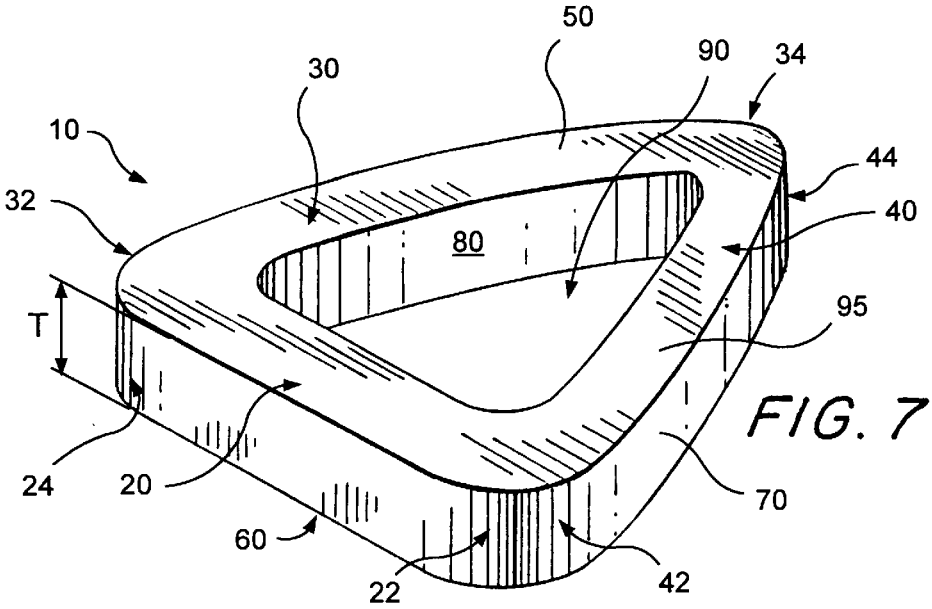
FIG. 7 is a perspective view of a second embodiment of the subject invention.
Figure 8:
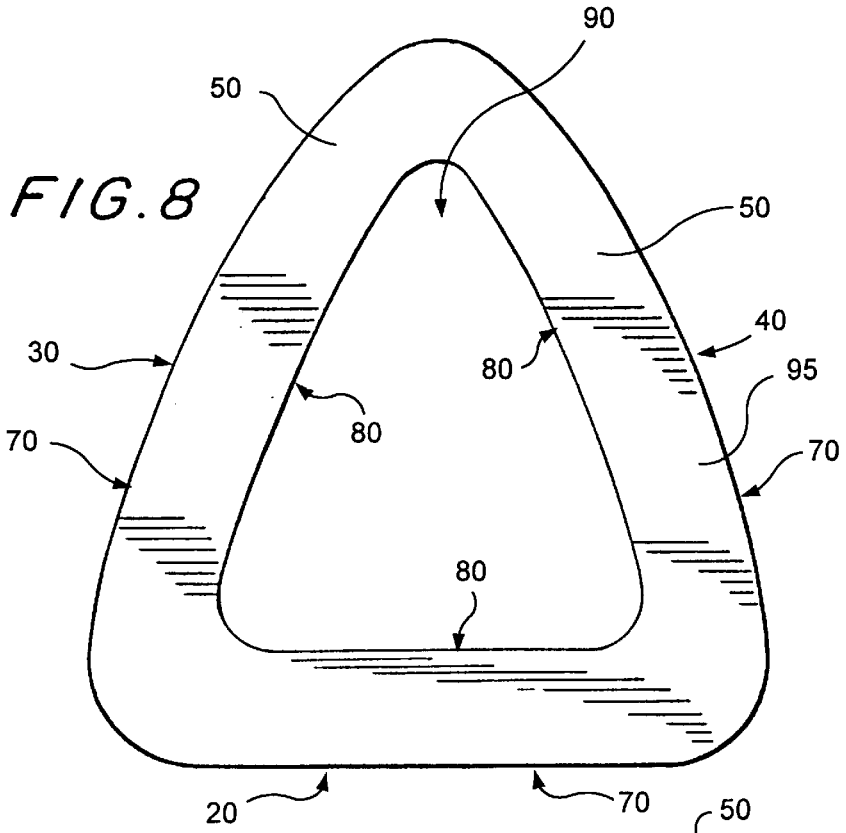
FIG. 8 is a top plan view of a second embodiment of the subject invention.
Figure 9:
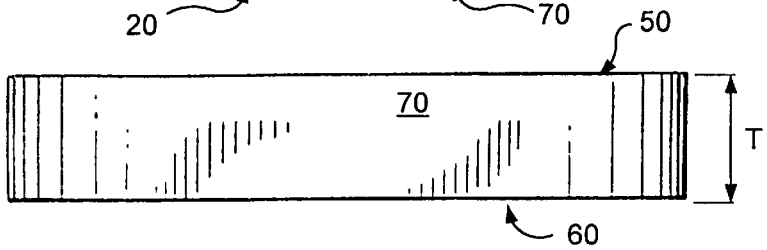
FIG. 9 is a front elevational view of a second embodiment of the subject invention.
Figure 10:
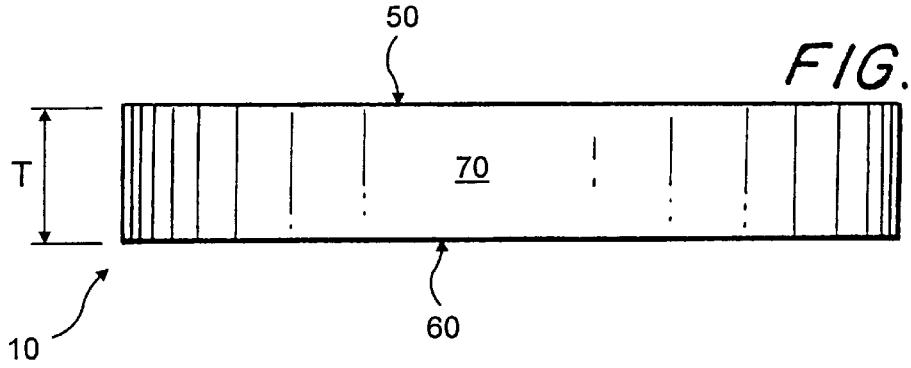
FIG. 10 is a left-side elevational view of a second embodiment of the subject invention, the right-side elevational view being a mirror image thereof.
Figure 11:
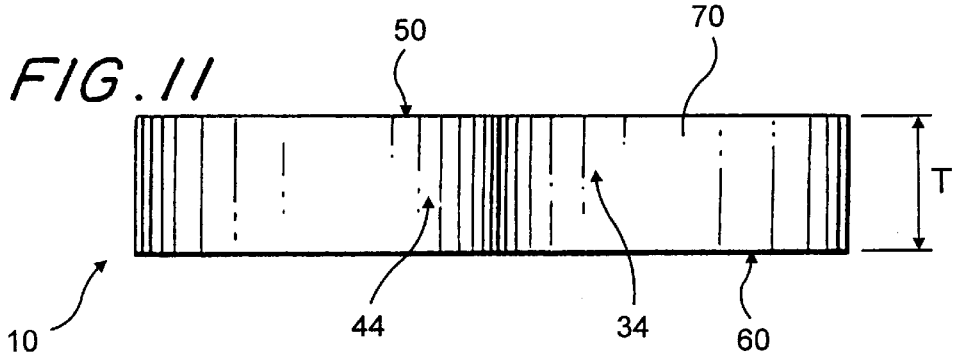
FIG. 11 is a rear elevational view of a second embodiment of the subject invention.
Figure 12:
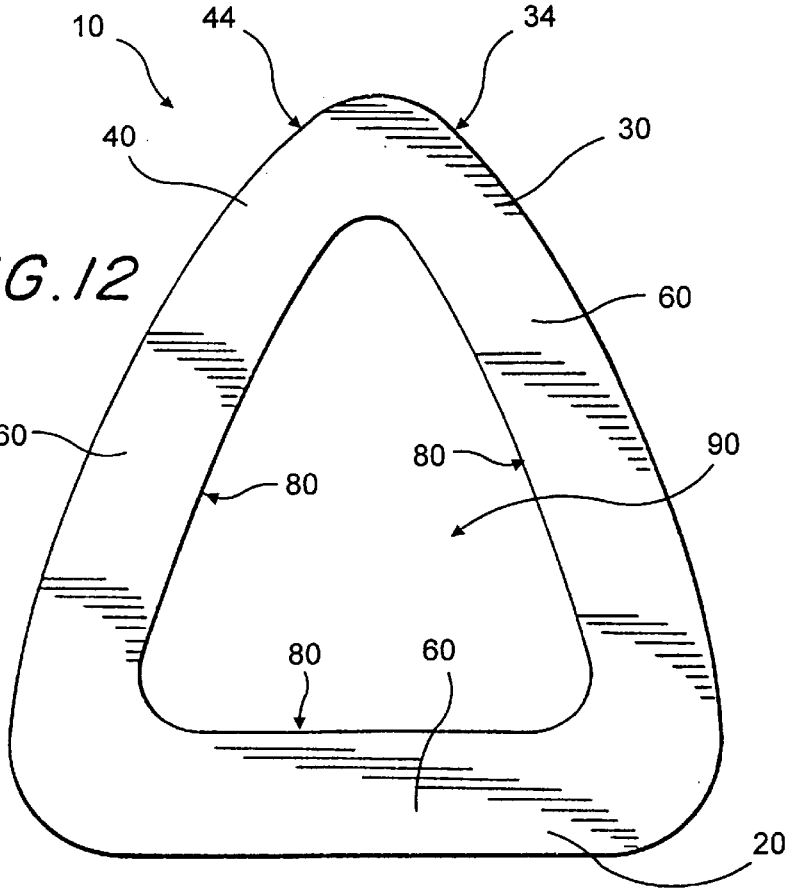
FIG. 12 is a bottom plan view of a second embodiment of the subject invention.
Figure 13:
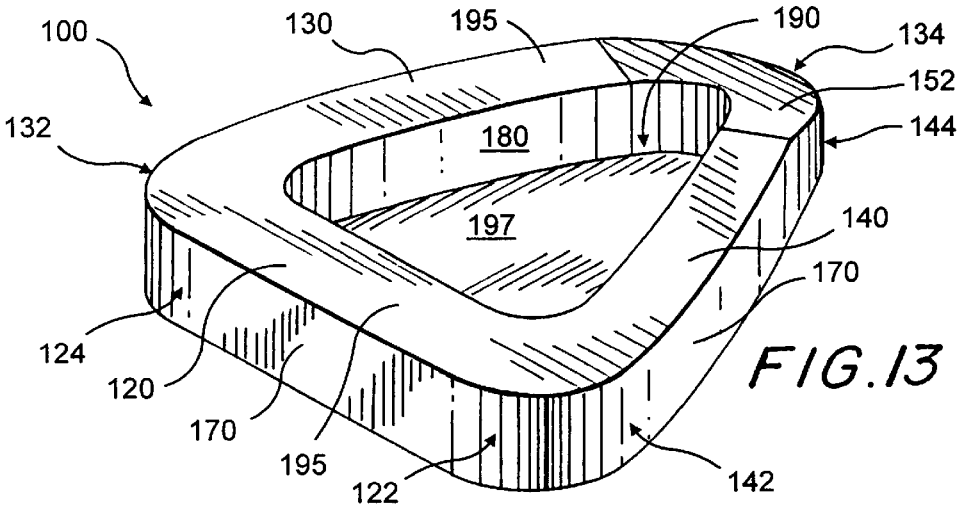
FIG. 13 is a perspective view of a third embodiment of the subject invention.
Figure 14:
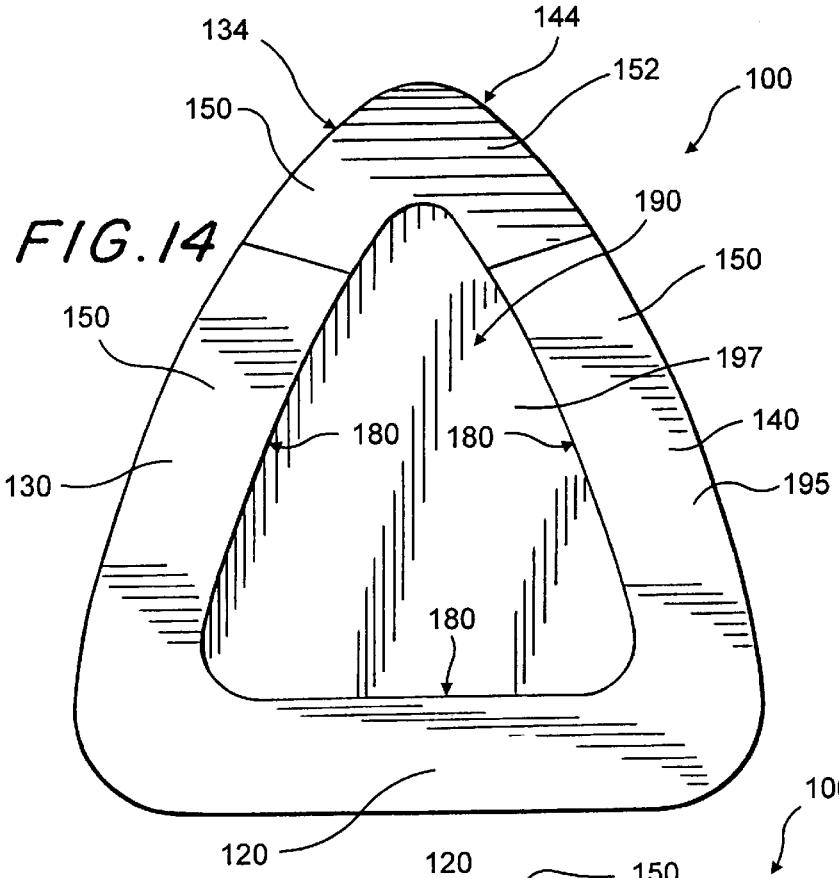
FIG. 14 is a top plan view of a third embodiment of the subject invention.
Figure 15:
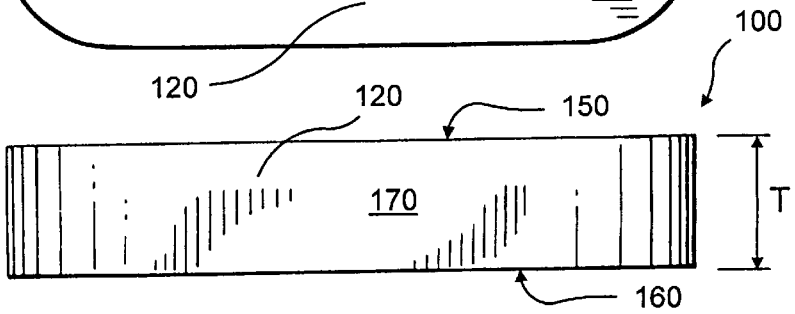
FIG. 15 is a front elevational view of a third embodiment of the subject invention.
Figure 16:
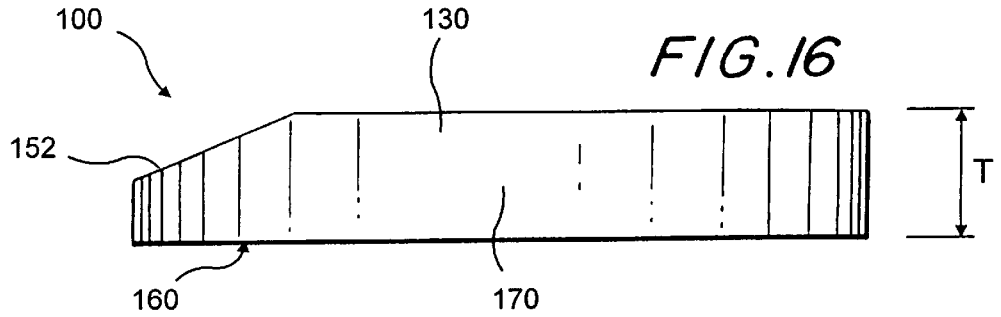
FIG. 16 is a left-side elevational view of a third embodiment of the subject invention, the right-side elevational view being a mirror image thereof.
Figure 17:
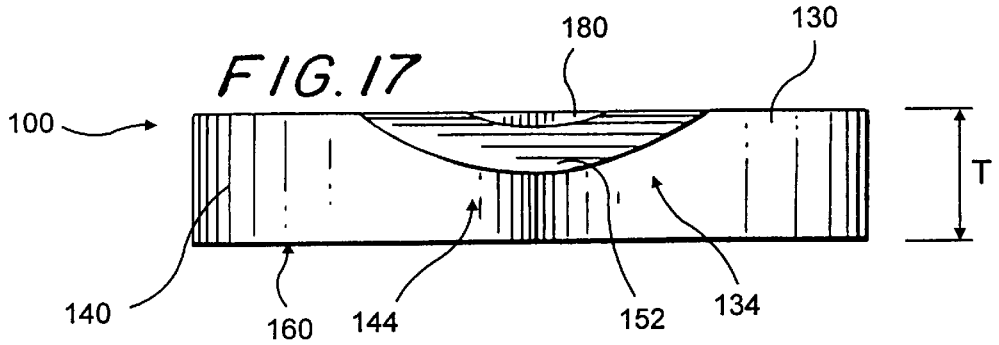
FIG. 17 is a rear elevational view of a third embodiment of the subject invention.
Figure 18:
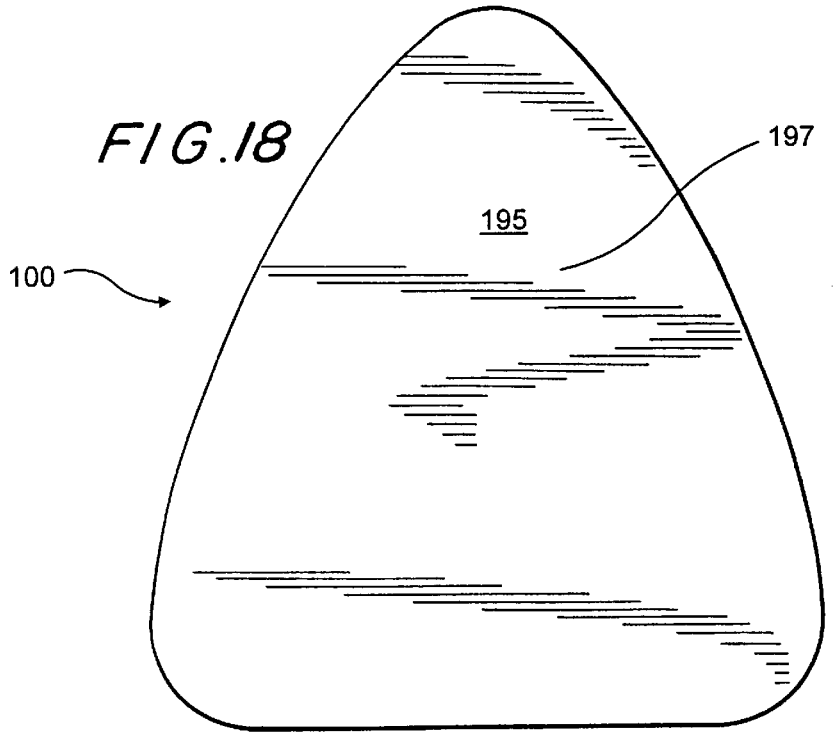
FIG. 18 is a bottom plan view of a third embodiment of the subject invention.
Figure 19:
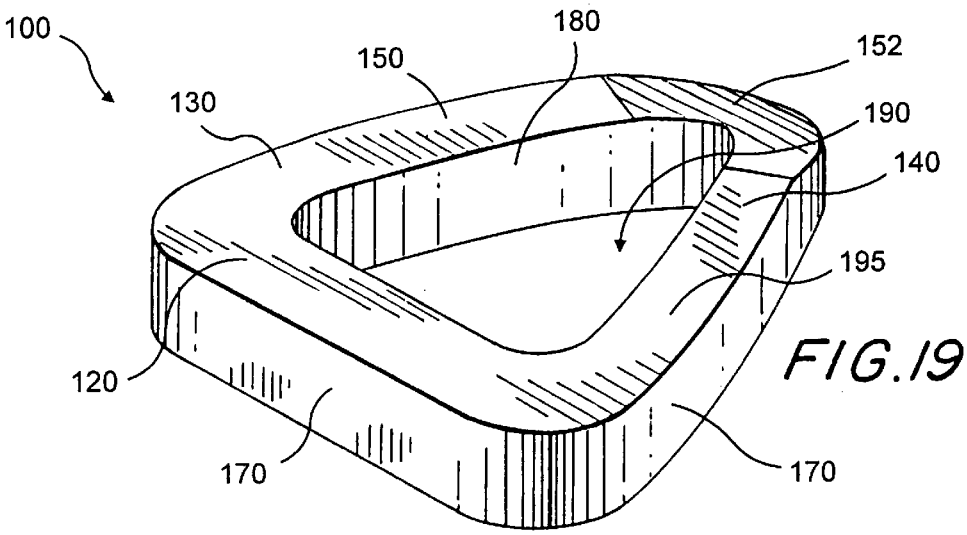
FIG. 19 is a perspective view of a fourth embodiment of the subject invention.
Figure 20:
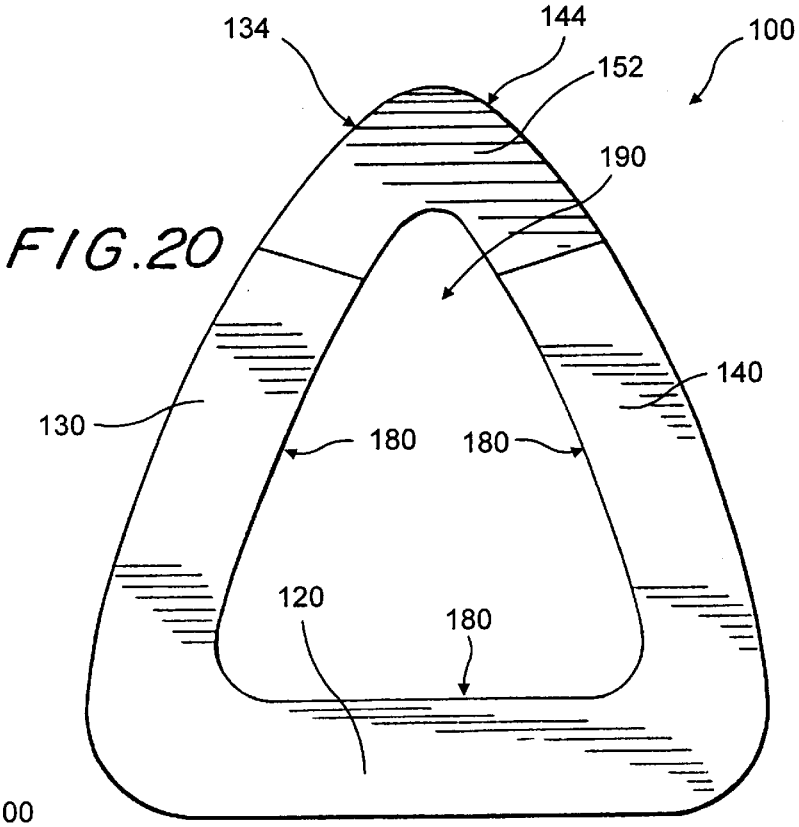
FIG. 20 is a top plan view of a fourth embodiment of the subject invention.
Figure 21:
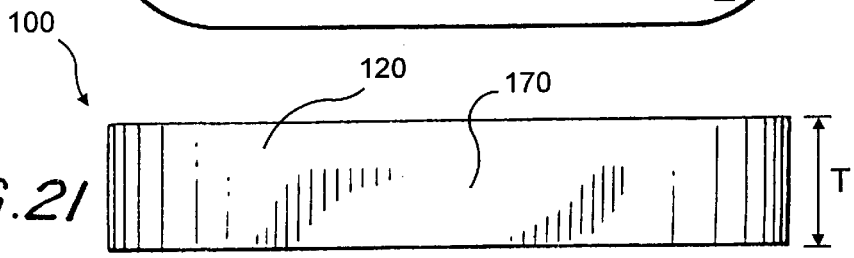
FIG. 21 is a front elevational view of a fourth embodiment of the subject invention.
Figure 22:
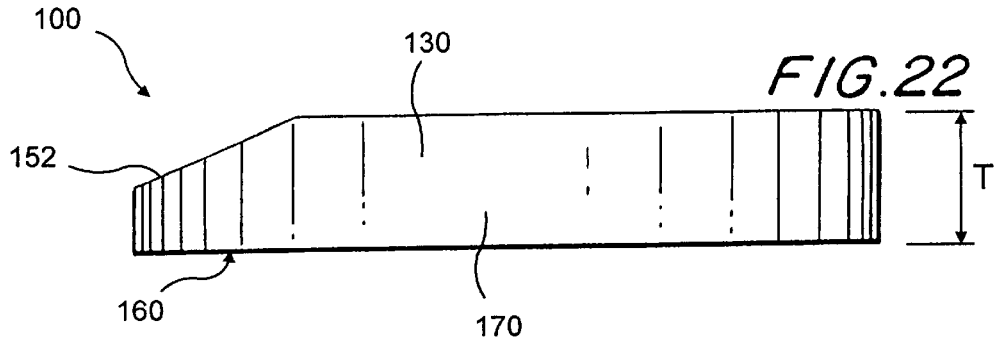
FIG. 22 is a left-side elevational view of a fourth embodiment of the subject invention, the right-side elevational view being a mirror image thereof.
Figure 23:
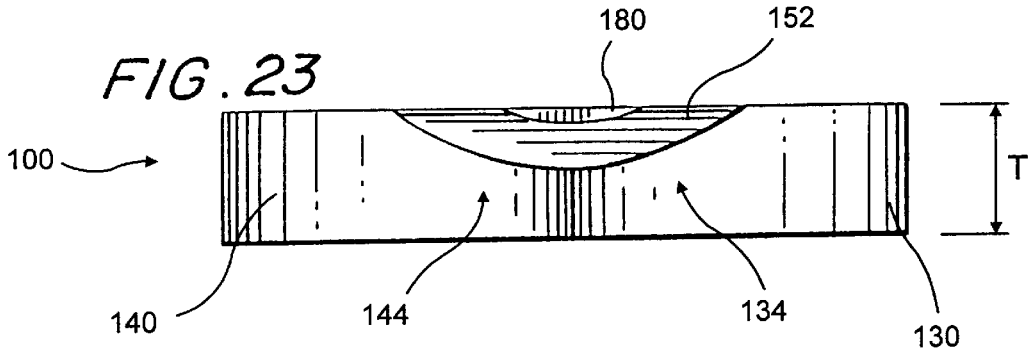
FIG. 23 is a rear elevational view of a fourth embodiment of the subject invention.
Figure 24:
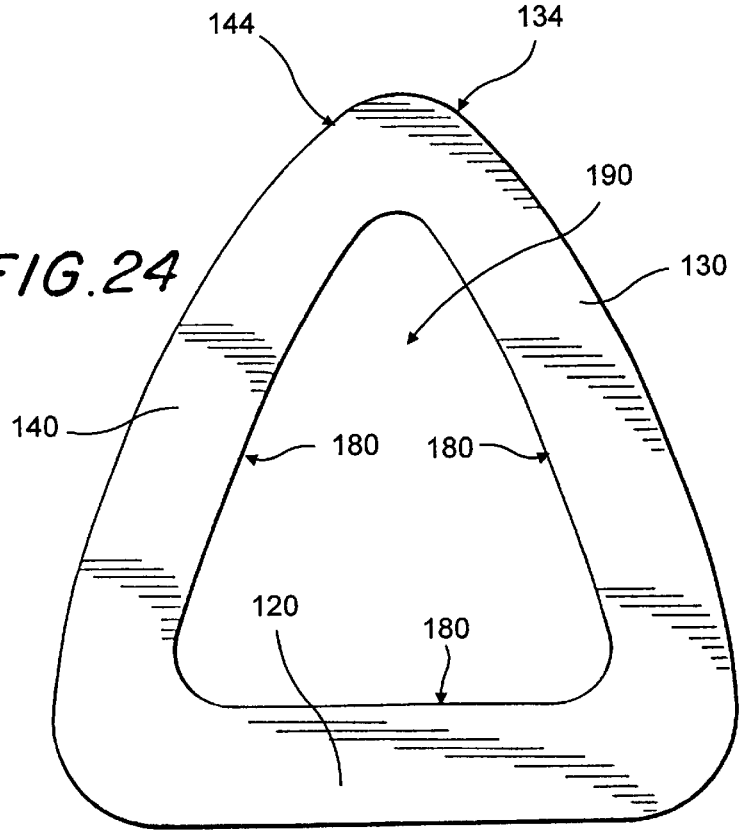
FIG. 24 is a bottom plan view of a fourth embodiment of the subject invention.
Figure 25:
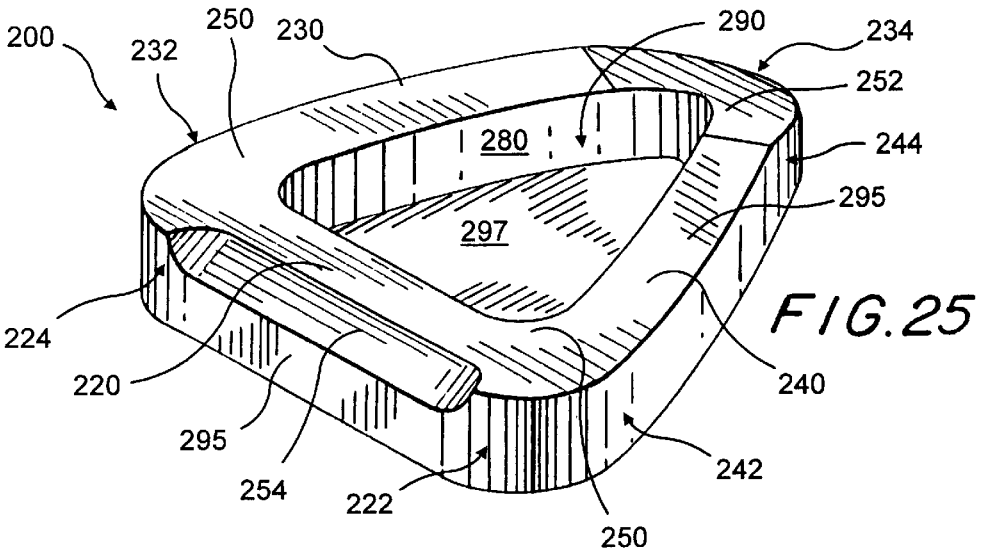
FIG. 25 is a perspective view of a fifth embodiment of the subject invention.
Figure 26:
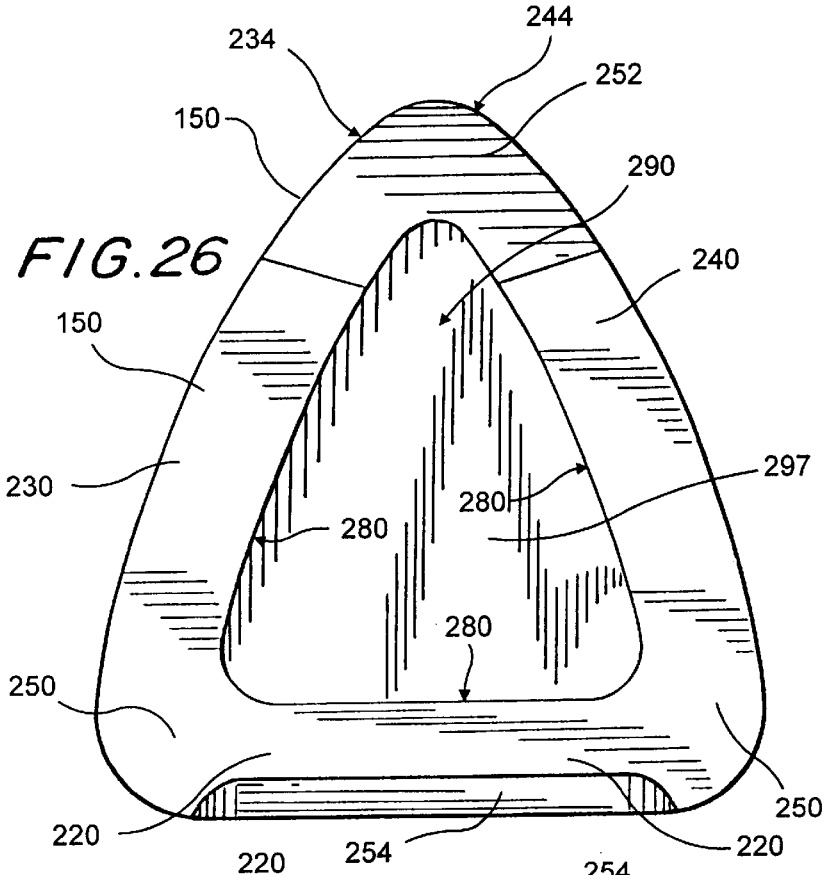
FIG. 26 is a top plan view of a fifth embodiment of the subject invention.
Figure 27:
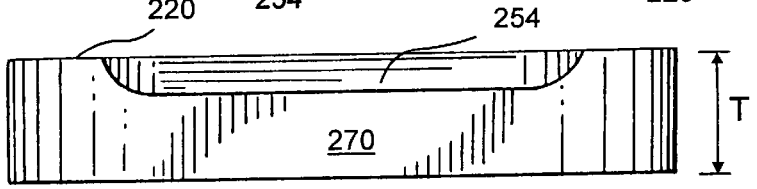
FIG. 27 is a front elevational view of a fifth embodiment of the subject invention.
Figure 28:
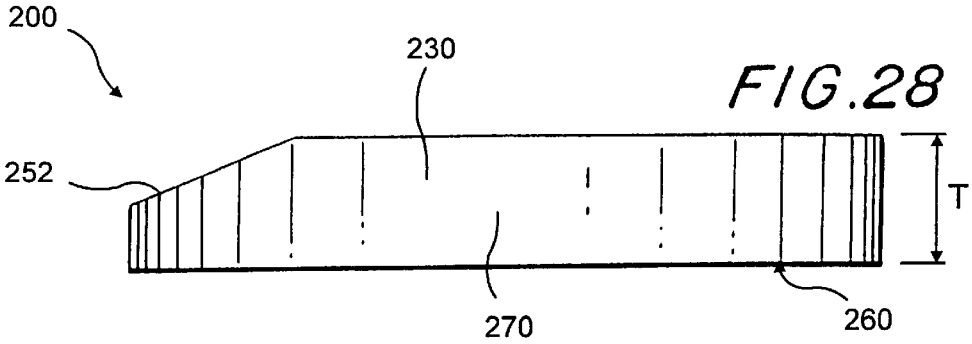
FIG. 28 is a left-side elevational view of a fifth embodiment of the subject invention, the right-side elevational view being a mirror image thereof.
Figure 29:
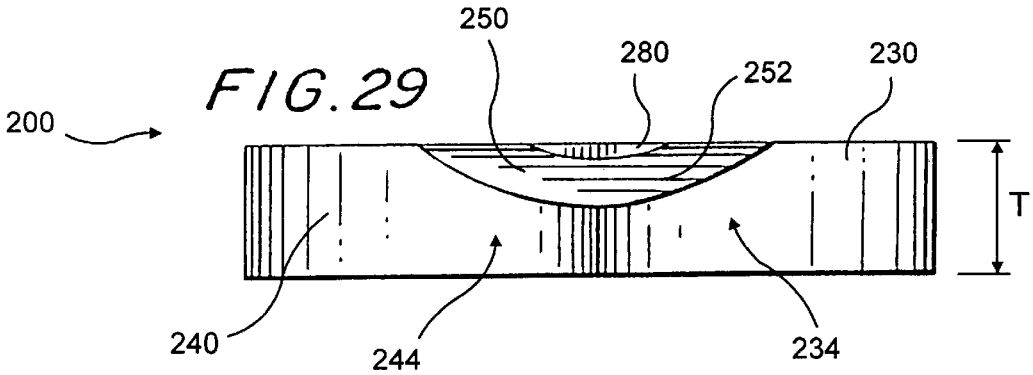
FIG. 29 is a rear elevational view of a fifth embodiment of the subject invention.
Figure 30:
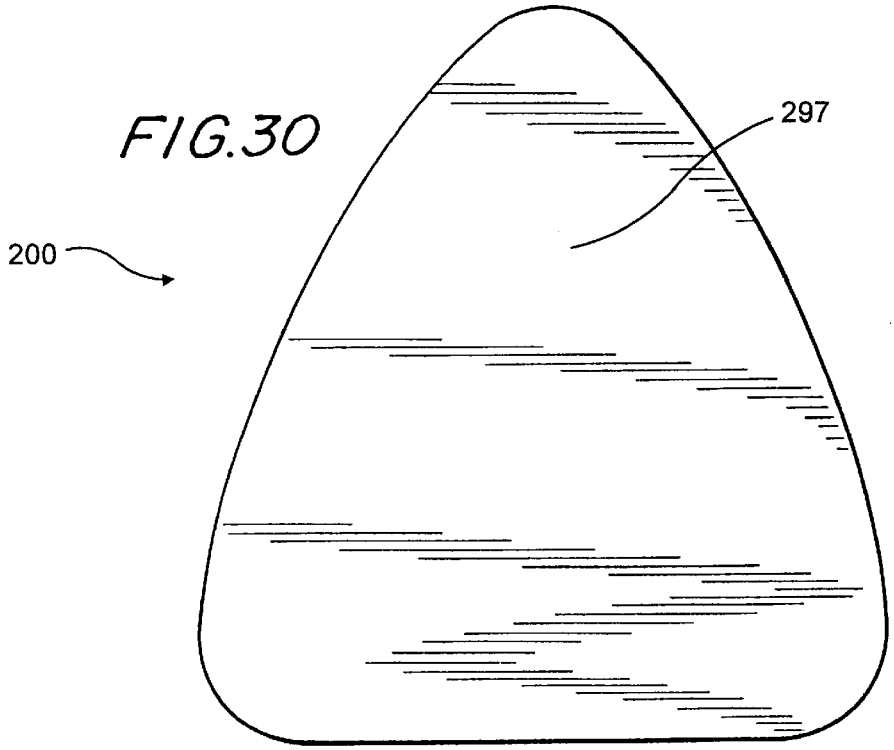
FIG. 30 is a bottom plan view of a fifth embodiment of the subject invention.
Figure 31:
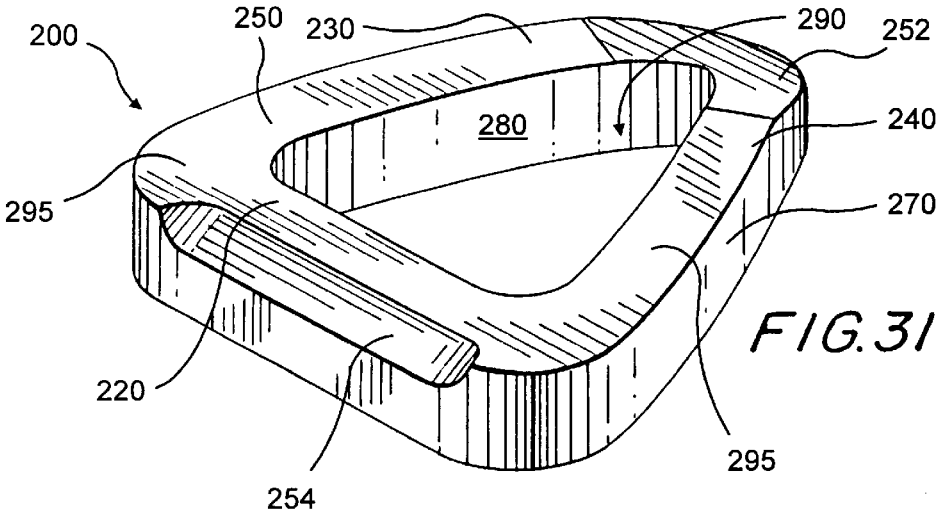
FIG. 31 is a perspective view of a sixth embodiment of the subject invention.
Figure 32:
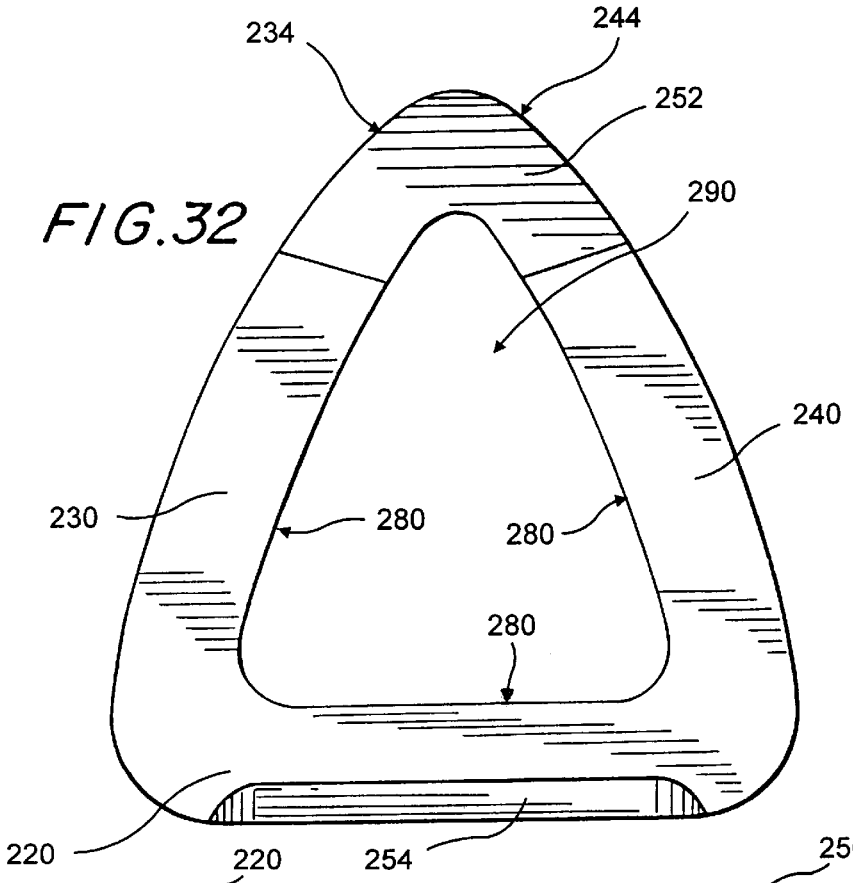
FIG. 32 is a top plan view of a sixth embodiment of the subject invention.
Figure 33:
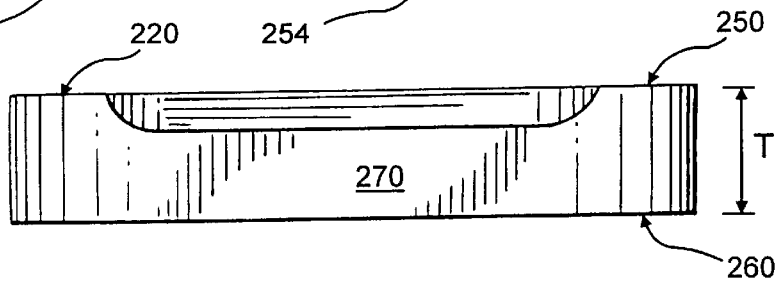
FIG. 33 is a front elevational view of a sixth embodiment of the subject invention.
Figure 34:
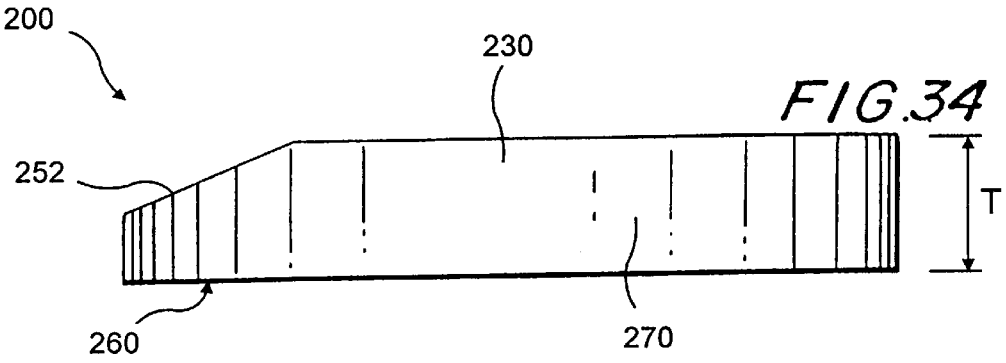
FIG. 34 is a left-side elevational view of a sixth embodiment of the subject invention, the right-side elevational view being a mirror image thereof.
Figure 35:
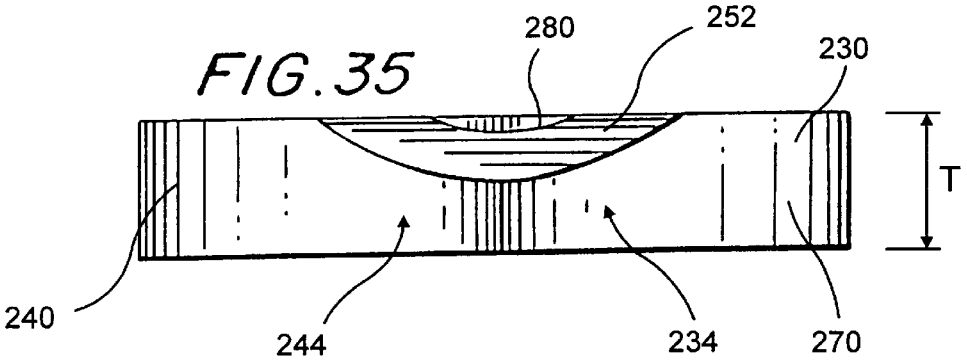
FIG. 35 is a rear elevational view of a sixth embodiment of the subject invention.
Figure 36:
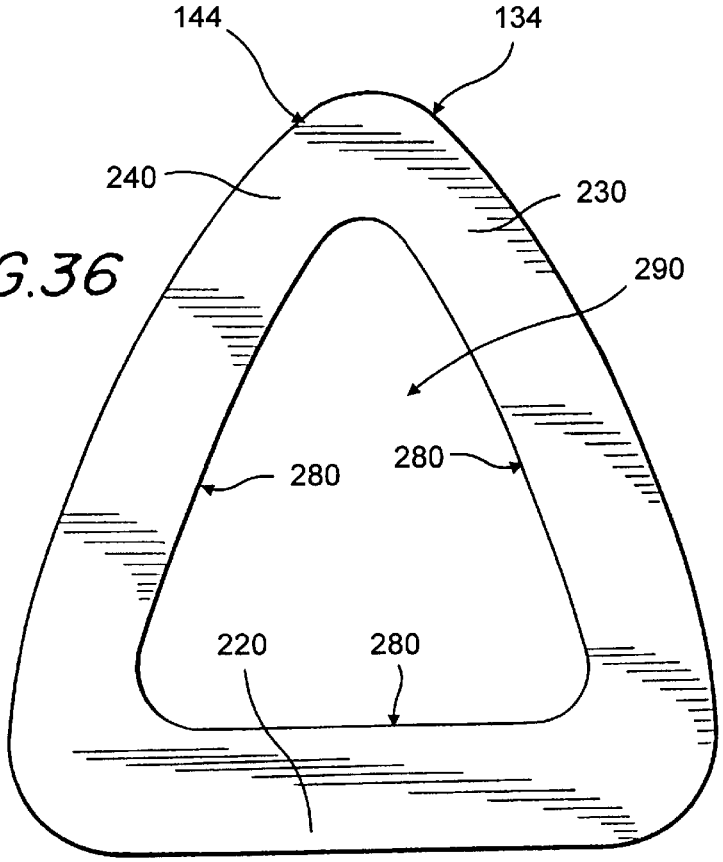
FIG. 36 is a bottom plan view of a sixth embodiment of the subject invention.

As is shown in the figures, first, second and third preferred embodiments of a pillow made in accordance with the subject invention, are seen at 10, 100 and 200, respectively. Pillows 10, 100 and 200 have first, second and third support structures 20, 30 and 40, respectively, for pillow 10, support structures 120, 130 and 140, respectively, for pillow 100, and support structures 220, 230 and 240, respectively, for pillow 200.

In the preferred embodiments, pillows 10, 100 and 200 are uniformly constructed, having a continuous form, so that support structures (20, 120 and 220), (30, 130 and 230) and (40, 140 and 240) are not attached to each other, or selectively unattachable from each other, but are one, continuous structure. In this way, continuous upper support surfaces 50, 150 and 250, continuous lower surfaces 60, 160 and 260, continuous outside walls 70, 170 and 270, and continuous inside walls 80, 180 and 280, respectively, are created.

The overall preferred shape of pillows 10, 100 and 200, is substantially that of a triangle. Having this shape, pillows 10, 100 and 200, when in use by a person lying in a prone position, are so situated that first support structures 20, 120 and 220 are located below the person's lower chest and upper abdominal regions of his/her body, second and third support structures (30, 130 and 230) and (40, 140 and 240) are located below the person's side-abdominal regions of his/her body, and such that second and third support structures (30, 130 and 230) and (40, 140 and 240) meet under the pelvic region of the person's body.

In further understanding the construction of pillows 10, 100 and 200, in the preferred embodiments thereof, first support structures 20, 120 and 220, have first and second ends (22, 122 and 222) and (24, 124 and 224), respectively. These first support structures are positioned so that they extend traversely below the person's lower chest and upper abdominal regions between first ends (22, 122 and 222) and (24, 124 and 224), respectively. In addition, second and third support structures (30, 130 and 230) and (40, 140 and 240) have first ends (32, 132 and 232) and (42, 142 and 242) and second ends (34, 134 and 234) and (44, 144 and 244), respectively, extending from first ends (22, 122 and 222) and second ends (24, 124 and 224) of the first support structures. These second and third support structures are positioned so that they extend along the right and left side-abdominal regions, respectively, of the person, when the person is lying prone on pillows 10, 100 and 200, and travel along the persons right and left side-abdominal regions from their first ends to their second ends.

Figure 37:
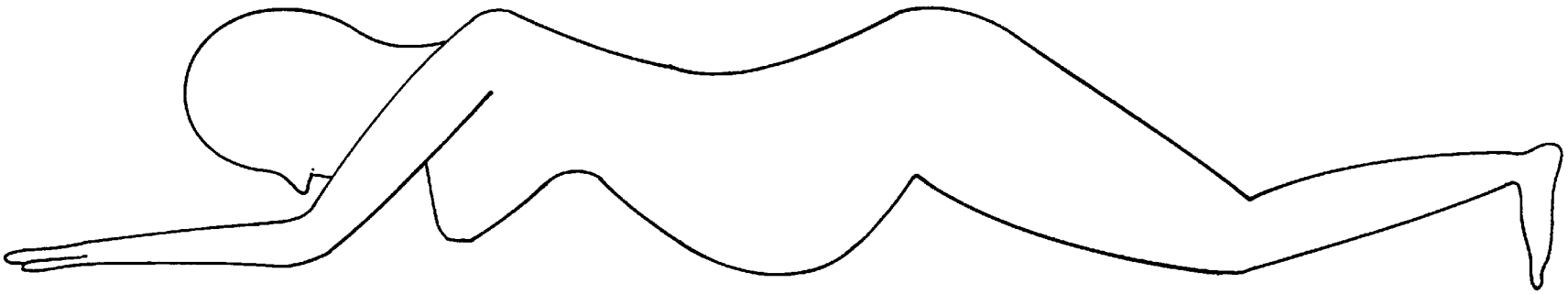
FIG. 37 is a view of a pregnant woman laying prone, showing the hyper-extension of the back.

Defined by continuous inside walls 80, 180 and 280, is an aperture 90, 190 and 290 extending through each of pillows 10, 100 and 200. These apertures receive therein the abdomen of the user of the pillow. These apertures are not designed to receive therein the breasts of the user. Instead, the lower portions of the user's breasts are positioned partially on first support structure 20, 120 or 220, and partially hanging downward therefrom, as best seen in FIG. 37, as regards a person lying prone on pillow 200.

As seen in the figures, pillows 10, 100 and 200 have substantially uniform thicknesses T, between the continuous upper support surfaces and the continuous lower surfaces. Uniform thickness T allows for the slight pelvic traction shown in FIG. 38.

Directing attention now to the second and third embodiments of FIGS. 13–24 and 25–36, respectively, one sees the chamfer area of continuous support surfaces 150 and 250. In particular, embodiment 2 shows a chamfer area of support surface 150, at 152. Chamferred area 152 is for receipt of the pelvic region of the user, and is solely for the user's comfort in that area. Further, embodiment 3 shows, in addition to a chamfer area 252, a chamferred area 254, located on first support structure 220. Chamfer area 254 is also solely for comfort (manly of the woman users), and is for receipt thereon of the bottom portions of the woman's breasts, as best seen in FIG. 38.

Neither chamfer areas 152, 252 or 254 extend the entire distance of the thickness T of the pillow, down toward continuous lower surface 160 or 260, from continuous upper support surface 150 or 250. As seen in the figures, these chamfer areas are simply portions of the surface upon which the user lies, which are downwardly slanted for more comfortable receipt of certain body parts of the user.

As seen in FIG. 37, if a person is lying prone, without pillow 10, 100 or 200, he/she will experience hyper-extension of the back. In this instance, the hyper-extension is such that the thoracic and lumbar vertebrae are in hyper-contraction, also causing the T1–T12 and L1–L5 discs to experience undue compressive pressure at their posterior sides.

Figure 38:
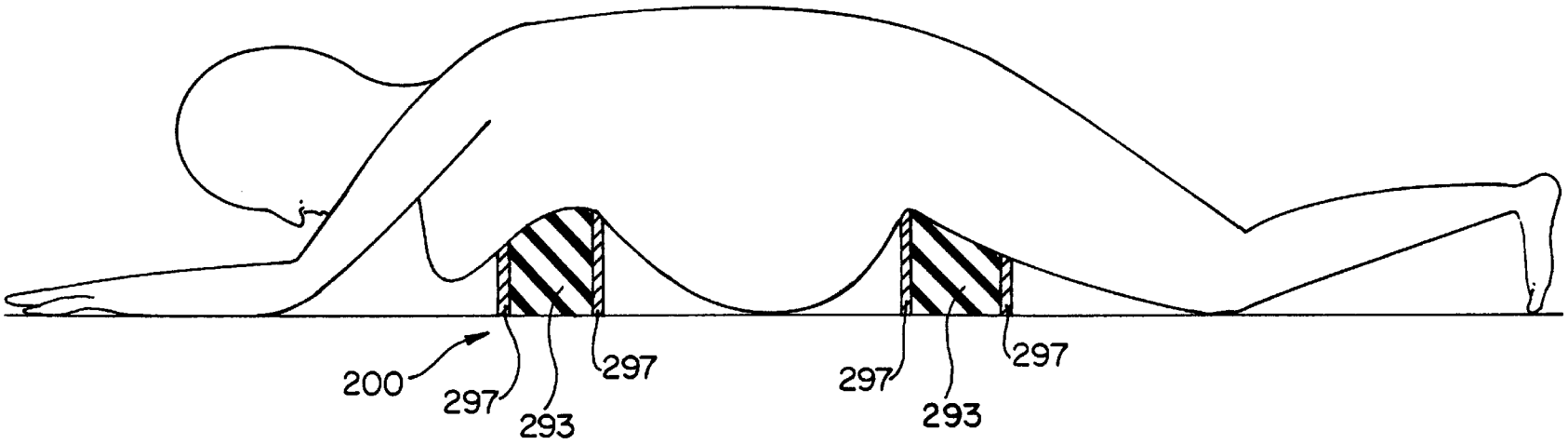
FIG. 38 is a view of the subject invention in cross-section showing a prone, pregnant woman lying thereon, showing the woman's back in slight pelvic traction.

As seen in FIG. 38, pillows 10, 100 and 200 allow for sight pelvic traction (pulling apart of the thoracic and lumbar vertebrae), allowing for gentle realignment of the person's back. This is accomplished by the person positioning his/her abdomen within apertures 90, 190 or 290 of the pillows, while the person's pelvic and chest regions are supported in such a way as to allow the abdomen to hang within the apertures.

As is seen best in FIGS. 1–6, 13–18, 25–30 and 38, pillows 10, 100 and 200 may have covers 95, 195 and 295, respectively. These covers can be of any natural or synthetic fabric, or any combination thereof, known in the fabric industry. The covers are selectively removable through use of zippers, snaps, Velcro, or any other known closure mechanism in the fabric industry (all now shown in the figures). FIGS. 1–6, 13–18 and 25–30 show the covers having bottom panels 97, 197 and 297, which close apertures 90, 190 and 290.

In addition to covers 95, 195 and 295, being of varying fabric types, the material used to make pillows 10, 100 and 200 cushiony can vary widely. For example, cushioning 93 (not shown), 193 (not shown) and 293 (seen in FIG. 38), can be foam, foul feathers, synthetic fiber material, or any other known material in the field.

Finally, it is to be understood that the subject pillow 10, 100 or 200 is preferred to be in the shape shown in the FIGS. (i.e., that substantially of a triangle), but that the invention does not dictate this shape. Due to the nature of the invention, the shape of the pillow may vary (for example, substantially square, oval, rectangular, etc.), so long as the pelvic and chest regions of the person are supported It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. For a pregnant, over weight, back-pain suffering, sleep apnea suffering, and sciatica suffering person having an abdomen, an upper-abdominal region, a lower-chest region, first and second side-abdominal regions and a pelvic region, a pillow for said person to lie prone upon, comprising:

an aperture extending through said pillow and sized to receive therein a substantial portion of said abdomen of said person, said aperture defined by at least first, second and third support structures of said pillow, wherein:

said first support structure extends substantially transversely across said lower-chest region and said upper-abdominal region of said person;

said second support structure has first and second ends and extends from said first end thereof, located at a first end of said first support structure, in a substantially longitudinal direction along said first side-abdominal region of said person, to said second end thereof so as to end proximate to said pelvic region of said person; and said third support structure has first and second ends and extends from said first end thereof, located at a second end of said first support structure, in a substantially longitudinal direction along said second side-abdominal region of said person, to said second end thereof so as to end proximate to said pelvic region of said person;

a chamfer portion located along said second ends of said second and third support structures, and proximate said pelvic region of said person; and a selectively removable cover comprising a panel;

wherein said person, lying prone on said pillow with said substantial portion of said abdomen positioned substantially within said aperture, is supported by said first, second and third support structures of said pillow, and said panel of said cover closes said aperture underneath said abdomen of said person.

2. For a pregnant, over weight, back-pain suffering, sleep apnea suffering, and sciatica suffering person having an abdomen, an upper-abdominal region, a lower-chest region, first and second side-abdominal regions and a pelvic region, a pillow for said person to lie prone upon, comprising:

an upper support surface in direct contact with portions of said pelvic, lower-chest and upper-abdominal and side-abdominal regions of said person to support said regions while said person is lying prone.

a lower surface for placement onto a substantially horizontal support surface, said upper and lower surfaces separated by a substantially uniform thickness of said pillow;

an abdomen receiving aperture defined through said upper and lower surfaces, for receipt therein of a substantial portion of said abdomen of said person;

a chamfer portion located along said upper support surface, proximate to said pelvic region of said person when said person is lying prone on said pillow; and a selectively removable cover comprising a panel, wherein said panel closes said aperture underneath said abdomen of said person, when said person is lying prone on said pillow.

3. For a pregnant, over weight, back pain suffering, sleep apnea suffering, and sciatica suffering person having an abdomen, an upper-abdominal region, a lower-chest region, first and second side-abdominal regions and a pelvic region, a pillow for said person to lie prone upon, comprising:

an aperture extending through said pillow and sized to receive therein a substantial portion of said abdomen of said person, said aperture defined by at least first, second and third support structures of said pillow, wherein:

said first support structure extends substantially transversely across said lower-chest region and said upper-abdominal region of said person;

said second support structure has first and second ends and extends from said first end thereof, located at a first end of said first support structure, in a substantially longitudinal direction along said first side-abdominal region of said person, to said second end thereof so as to end proximate to said pelvic region of said person; and said third support structure has first and second ends and extends from said first end thereof, located at a second end of said first support structure, in a substantially longitudinal direction along said second side-abdominal region of said person, to said second end thereof so as to end proximate to said pelvic region of said person;

wherein said first, second and third support structures are continuously formed, creating a continuous upper support surface and a continuous lower surface, each defined by a continuous outside wall and a continuous inside wall;

a thickness defined between said continuous upper support surface and said continuous lower surface;

a first chamfer portion located along said second ends of said second and third support structures, proximate said pelvic region of said person, and extending in a direction from said first ends toward said second ends of both of said second and third support structures, and said first chamfer portion extending fully between said continuous inside and outside walls and only part way down from said continuous upper support surface toward said continuous lower surface of said pillow, so that said thickness of said pillow decreases along said first chamfer portion, in a direction from said first ends toward said second ends of both of said second and third support structures; and a second chamfer portion located along said first support structure;

wherein said person, lying prone on said pillow with said substantial portion of said abdomen positioned substantially within said aperture, is supported along said continuous upper support surface by said first, second and third support structures of said pillow.

4. A pillow as recited in claim 3, wherein said second chamfer portion of said pillow extends only part way between said continuous inside and outside walls, and only part way down from said continuous upper support surface toward said continuous lower surface of said pillow.

5. For a pregnant, over weight, back-pain suffering, sleep apnea suffering, and sciatica suffering person having an abdomen, an upper-abdominal region, a lower-chest region, first and second side-abdominal regions and a pelvic region, a pillow for said person to lie prone upon, comprising:

an aperture extending through said pillow and sized to receive therein a substantial portion of said abdomen of said person, said aperture defined by at least first, second and third support structures of said pillow, wherein:

said first support structure extends substantially transversely across said lower-chest region and said upper-abdominal region of said person;

said second support structure has first and second ends and extends from said first end thereof, located at a first end of said first support structure, in a substantially longitudinal direction along said first side-abdominal region of said person, to said second end thereof so as to end proximate to said pelvic region of said person; and said third support structure has first and second ends and extends from said first end thereof, located at a second end of said first support structure, in a substantially longitudinal direction along said second side-abdominal region of said person, to said second end thereof so as to end proximate to said pelvic region of said person;

wherein said first, second and third support structures are continuously formed, creating a continuous upper support surface and a continuous outside wall and a continuout inside wall continuous outside wall and a continuous inside wall;

a thickness defined between said continuous upper support surface and said continuous lower surface; and a chamfer portion located along said first support structure wherein said person, lying prone on said pillow with said substantial portion of said abdomen positioned substantially within said aperture, is supported along said continuous upper support surface by said first, second and third support structures of said pillow.

6. A pillow as recited in claim 5, wherein said chamfer portion of said pillow extends only part way between said continuous inside and outside walls, and only part way down from said continuous upper support surface toward said continuous lower surface of said pillow.

* * * * *